US005131915A

United States Patent [19]

Mendoza

[11] Patent Number: 5,131,915

[45] Date of Patent: Jul. 21, 1992

[54] METHOD OF FORMING DESIGNS ON CELLULOSE FABRICS: DISCHARGE PRINT, A DYED CELLULOSE FABRIC

[75] Inventor: Benegildo R. Mendoza, Paranaque, Philippines

[73] Assignee: Arler Corporation/Arler International, New York, N.Y.

[21] Appl. No.: 281,318

[22] Filed: Dec. 8, 1988

[30] Foreign Application Priority Data

Jan. 11, 1988 [PH] Philippines ..... 36344

[51] Int. Cl.[5] ..... D06P 5/15

[52] U.S. Cl. ..... 8/457; 8/101; 8/108.1; 8/458; 8/633; 8/918

[58] Field of Search ..... 8/457, 108.1

[56] References Cited

U.S. PATENT DOCUMENTS

| | | | |
|---|---|---|---|
| 2,004,043 | 6/1935 | Engels | 8/111 |
| 3,074,774 | 1/1963 | Sapers et al. | 8/457 |
| 3,445,177 | 5/1969 | McKesson | 8/457 |
| 3,476,505 | 11/1969 | Kirner et al. | 8/139 |
| 3,481,684 | 12/1969 | Sando et al. | 8/111 |
| 4,252,530 | 2/1981 | Ribka et al. | 8/457 |

FOREIGN PATENT DOCUMENTS

| | | | |
|---|---|---|---|
| 55-030423 | 3/1980 | Japan | 8/402 |
| 56-123490 | 9/1981 | Japan | 08/402 |

OTHER PUBLICATIONS

Kirk-Othmer, "Encylopedia of Chemical Technology", vol. 3, Third Edition, John Wiley & Sons, pp. 948-950 (1978).

Fairchild's Dictionary of Textiles, (Fairchild Publications, Inc, New York), 1975, p. 185.

*Primary Examiner*—A. Lionel Clingman

*Attorney, Agent, or Firm*—Armstrong, Nikaido, Marmelstein, Kubovcik & Murray

[57] ABSTRACT

A pattern or design is formed on an already dyed cellulose-containing fabric by wetting preselected portions of the fabric with a solution containing a bleaching agent, drying the wetted fabric by heating at about 100° C., and washing the dried fabric free of residual chemicals.

11 Claims, No Drawings

METHOD OF FORMING DESIGNS ON CELLULOSE FABRICS: DISCHARGE PRINT, A DYED CELLULOSE FABRIC

This invention relates to a method for forming designs on cellulose fabrics. In one specific aspect, it relates to a method for forming a design on a dyed cellulose fabric by the decolorization or bleaching of preselected portions of the fabric.

BACKGROUND OF THE INVENTION

The art of dyeing cotton and other cellulose-containing fabrics is, of course, well known. It is also well known to bleach cotton or cellulose-containing fabrics with various oxidizing agents such as chlorine and/or peroxides.

In recent years, a style of pants designated jeans has become a favorite article of attire for children and adults of both sexes. Jeans are generally made from a coarse, twilled cotton cloth or fabric commonly known as denim. Jeans, and also jackets, shirts, dresses, skirts and other articles of clothing or apparel made of blue denim, are particularly in vogue.

It has become popular, mostly with young adults or those believing themselves to be young adults, to wear apparel made from blue denim cloth having a washed-out look. This look was initially achieved by repeatedly wearing and washing the apparel. Arrival at the washed-out look was often accelerated by using excess bleach during washing.

The washed-out look became so fashionable that pre-washed jeans (never-worn jeans treated to look worn) and other pre-washed articles of clothing made from blue denim fabric are now commercially available. Stylish variations of pre-washed denim apparel, particularly jeans, jackets and skirts, include the "stone-washed" look and the "frosted" look. Neither pre-washed denim apparel nor "stone-washed" or "frosted denim" apparel can be said to have or display a regular pattern or design.

DISCUSSION OF THE PRIOR ART

As taught in U.S. Pat. No. 3,476,505, it is common practice to bleach cotton or cellulose-containing fabrics with aqueous solutions of oxidizing agents such as hypochlorites and hydrogen peroxide, and it is known that such strong oxidizing agents can damage cotton fibers. As taught in U.S. Pat. No. 4,622,307, in order to keep such damage to a minimum, the general practice has been to effect bleaching operations at temperatures not much above room temperature and under alkaline conditions, and that relatively long periods of time are required for bleaching under such mild conditions. That patent also teaches that bleaching can be effected more rapidly at 90°-110° C. with little damage to the cotton fibers, if certain readily oxidizable substances are present.

U.S. Pat. No. 3,481,684 describes a continuous bleaching and refining process wherein a textile fabric is treated in a closed system with acidified chlorite at about 80°-85° C., washed with water, and then treated with an alkaline peroxide at 85°-90° C., also in a closed system.

U.S. Pat. No. 2,004,043 teaches a method for producing markings on animal skins and leathers which comprises applying a bleaching agent to selected areas of those skins or leathers. The prior art does not provide a convenient method for forming predetermined patterns or designs on a dyed cellulose or cellulose-containing fabric, such as would be selected or required by a pattern maker.

BRIEF DESCRIPTION OF THE PRESENT INVENTION

It is an object of the present invention to provide a convenient method for forming predetermined designs or patterns on a dyed cellulose or cellulose-containing fabric by the decolorization or bleaching of preselected portions of the fabric. More specifically, the present invention is a method for forming designs or patterns on a cellulose-containing fabric which comprises:

a) covering portions of a dyed cellulose-containing fabric to form covered and uncovered portions of the fabric in the shape of the design or pattern to be formed, b) wetting the uncovered portions of the fabric with an aqueous solution of a bleaching agent, c) drying the wetted fabric by heating at about 100° C. until 90% of the water is evaporated, and d) washing the dried fabric with water.

In an alternate embodiment, the present invention is a method for forming a design or pattern on a dryed cellulose-containing fabric which comprises:

a) wetting portions of the fabric corresponding to the design or pattern to be formed by brushing those portions with an aqueous solution of a bleaching agent, b) drying the water-wetted fabric by heating at about 100° C. until 90% of the water is evaporated, and c) washing the dried fabric with water.

In another alternate embodiment, the present invention is a method for forming a design or pattern on a dyed cellulose-containing fabric which comprises:

a) forming the corresponding pattern or design on a silkscreen, b) contacting the silkscreen with the fabric, c) coating the silkscreen with a viscous aqueous composition containing a bleaching agent, d) applying pressure to the composition containing the bleaching agent on the silkscreen, e) separating the silkscreen from the fabric, f) drying the wetted-fabric by heating at about 100° C. until 90% of the water is evaporated, and g) washing the dried fabric with water.

DETAILED DESCRIPTION OF THE INVENTION

The present invention relates to a method for the decolorization of cellulose fabrics, particularly for the decolorization of specific, preselected areas for the purpose of creating a distinct pattern or design on those fabrics. The present method is the opposite of printing in that the dye or print in a dyed or colored fabric is selectively removed. Thus, the result achieved by the present method may be designated "deprinting".

The method of the present invention is applicable to deprinting cellulose or cellulose-containing fabrics, such as fabrics made of rayon, cotton, jute or ramie, or blends with synthetics, such as polyesters or acrylates, or cut and sewn finished products like pants, shirts, sweaters, jackets, or other articles of apparel made from such fabrics. In practicing the present method, preselected portions of the fabrics or articles of apparel are covered or by tapes, markers or the like in the shape of the patterns or design to be formed. The uncovered or exposed portions are wetted thoroughly with an aqueous solution of a bleaching agent by contacting the exposed portions with the solution, for example, by immersion in the solution, by spraying with the solution, or by applying the solution with rollers, until those exposed portion are wetted to the degree desired. In alternate embodiments, the uncovered fabric is wetted by means of a brush (preselected portions only) or by means of a solution applied through a patterned silkscreen. Wetting may be for a predetermined period of time or until a desired degree of decolorization is visually observed.

Chlorine-containing and peroxide-containing bleaching agents and solutions containing bleaching agents suitable for practicing the deprinting method of the present invention are generally known and are commercially available. A non-limiting list of such bleaching agents would include chlorine, alkali metal and alkaline earth chlorites and hypochlorites, hypochlorite donors such as di- and trichloroisocyanurates, and hydrogen peroxides. Those bleaching agents are generally available and/or utilized in aqueous formulation at concentrations of about 7-10%. Those formulations may contain various additives and stabilizers, both to stabilize the bleaching agent and to minimize damage to the fibers being bleached. Particularly preferred as bleaching agents for use in deprinting dyed fabrics using the method of the present invention are chlorine in combination with $NaHPO_3$ or $Ca_2HPO_3$, and hydrogen peroxide. The bleaching solution containing the bleaching agent is generally at a mildly alkaline pH of about 8.5 to 10.

When the desired degree of wetting has been achieved, the wetted fabric is quickly heated to about 100° C., or slightly above that temperature, to evaporate water from the fabric until the fabric is at least about 90% free of water. This generally takes about 1-3 minutes when dry heating is utilized, for example, by passing the wet fabric over a heated metal surface, such as a steam press, an electric flat iron or a steam iron. When drying is effected by passing heated air through the fabric, for example, using a tumble dryer, about 30 minutes to one hour are required for removing 90% of the water present.

It is important that, after the fabric has been 90-100% dried, that it be washed with water, preferably soft water, to free it of residual chemicals. Preferably, washing should be within 2 hours after drying and, at most, within 8 hours after drying of the fabric, in order to avoid serious damage to the cellulose fibers in the fabric. The wash water may contain a small amount of an alkaline detergent composition to assist in removing dirt and soil, as well as residual chemicals, from the fabric.

The deprinting method of the present invention is further illustrated by means of the following non-limiting examples. In these examples, the cellulose fabric was commercially produced blue denim fabric or that fabric made into pants, shirts and jackets. In Examples 1, 2 and 3, the fabric or articles of apparel made therefrom referred to collectively as goods, were covered before deprinting in selected portions by tapes, markers or patterns specifically chosen to correspond to the desired pattern or design to be imparted to the fabric. Then, the pre-selected and/or uncovered or exposed portions of the fabric were wetted thoroughly with an aqueous solution containing the bleaching agent using the wetting procedure illustrated in the examples. The wetted fabric or article of apparel was then dried by ironing for 1-3 minutes, after which the goods were washed with soft water containing a small alkali detergent compound.

EXAMPLE I

This example illustrates wetting by spraying. Blue denim pants, after covering specific portions with tapes, were hung by means of clips on their waist portions from hangers. Using a spray gun, a solution of the bleaching agent was sprayed onto the areas of the pants not covered by the tapes until a marked decolorization of the sprayed area was observed. The pants were then removed from the hangers, dried by pressing with an electric flat iron, and washed with soft water for about 30 minutes containing a small amount of detergent. The wash water had a pH of about 7.5-8.0.

EXAMPLE II

This example illustrates wetting by immersion. Blue denim pants, after covering specific portions with tapes, were immersed 3-5 minutes in a stirred solution of the bleaching agent in a plastic container. After some deprinting had been observed, the pants were removed from the container and excess solution was removed by dripping. The drip-dried pants were iron dried and washed with soft water and alkali detergent as in the previous example.

EXAMPLE III

This example illustrates wetting using foamed rollers. Blue denim pants, shirts and jackets, after covering specific portions with tapes and/or markers, were repeatedly pressed between foamed rollers containing the solution of bleaching agent until the desired level of wetness was reached. The tapes or markers were removed, and the wetted portions were steam ironed to dryness. The goods were then washed as in the previous examples.

EXAMPLE IV

This example illustrates wetting by means of a brush. When using a brush for wetting, it is not necessary to cover those portions of the goods which are not to be decolorized. The brush was used to apply the solution containing the bleaching to preselected portions of the denim cloth. The wetted fabric was then ironed dry and washed free of residual chemicals as in the previous examples.

EXAMPLE V

This example illustrates deprinting using a silkscreen to impart a design onto the fabric. First, a design was formed on a silkscreen, and the screen placed in contact with the fabric. Then, a viscous aqueous bleaching composition containing about 17.5% of available chlorine, liquid detergent and a softening agent was placed on the silkscreen, and squeezed through the screen onto the fabric. The silkscreen was removed, and the fabric was dried by ironing and washed with soft water. The fabric strengths of the fabrics or articles of attire deprinted using the procedure of the previous examples were tested by manual stretching. The deprinted areas were observed to have the same strength as that of the areas not exposed to the bleaching agent. Thus, the present invention provides a convenient method for imparting fashionable patterns or designs to fabrics or to wearing apparel without significant damage to the cellulose fibers in such fabrics or goods.

What is claimed is:

1. A method for forming a design or pattern on a dyed cellulose-containing fabric which comprises:

a) covering portions of a dyed cellulose-containing fabric to form covered and uncovered portions of the fabric corresponding to the design or pattern to be formed, b) wetting the uncovered portions of the fabric with an aqueous solution of a bleaching agent, c) drying the water-wetted fabric by heating at about 100° C. until 90% of the water is evaporated, and e) washing the dried fabric with water.

2. A method according to claim 1, wherein the uncovered portions of the fabric are wetted by spraying with the solution of the bleaching agent.

3. A method according to claim 1, wherein the uncovered portions of the fabric are wetted by immersion in the solution of the bleaching agent.

4. A method according to claim 1, wherein the uncovered portions of the fabric are wetted by contact with foamed rollers containing the solution of the bleaching agent.

5. A method according to claim 1, wherein the fabric is contained in an article of apparel.

6. A method according to claim 1, wherein the bleaching agent is chlorine in combination with an alkali metal or alkaline earth metal acid phosphite.

7. A method according to claim 1, wherein the wetted fabric is iron-dried.

8. A method according to claim 1, wherein the wetted fabric is tumble-dried.

9. A method according to claim 1, wherein the dried fabric is washed with soft water.

10. A method for forming a design or pattern on a dyed cellulose-containing fabric which comprises:

a) wetting portions of the fabric corresponding to the design or pattern to be formed by brushing those portions with an aqueous solution of a bleaching agent, b) drying the water-wetted fabric by heating at about 100° C. until 90% of the water is evaporated, and c) washing the dried fabric with water.

11. A method for forming a design or pattern on a dyed cellulose-containing fabric which comprises:

a) forming the corresponding pattern or design on a silkscreen, b) contacting the silkscreen with the fabric, c) coating the silkscreen with a viscous aqueous composition containing a bleaching agent, d) applying pressure to the composition containing the bleaching agent on the silkscreen, e) separating the silkscreen from the fabric, f) drying the wetted-fabric by heating at about 100° C. until 90% of the water is evaporated, and g) washing the dried fabric with water.

* * * * *